United States Patent [19]

Fujikawa

[11] Patent Number: 4,915,045

[45] Date of Patent: Apr. 10, 1990

[54] SEWING MACHINE CONTROL DEVICE

[76] Inventor: Katsuhiro Fujikawa, c/o Mitsubishi Denki Kabushiki Kaisha Nagoya Works, No. 1-14, Yadaminami 5-chome, Higashi-ku, Nagoya-shi, Aichi, Japan

[21] Appl. No.: 904,127

[22] Filed: Sep. 5, 1986

[30] Foreign Application Priority Data

Sep. 5, 1985 [JP] Japan ..... 60-196209

[51] Int. Cl.[4] ..... D05B 69/26

[52] U.S. Cl. ..... 112/275; 112/277

[58] Field of Search ..... 112/275, 277, 121.11, 112/121.12, 67, 87; 377/16; 364/551, 569

[56] References Cited

U.S. PATENT DOCUMENTS

| | | | |
|---|---|---|---|
| 4,104,976 | 8/1978 | Landau, Jr. et al. | 112/275 X |
| 4,137,860 | 2/1979 | Yoneji et al. | 112/277 |
| 4,142,238 | 2/1979 | Brandt et al. | 364/569 X |
| 4,180,724 | 12/1979 | Councilman et al. | 377/16 |
| 4,490,656 | 12/1984 | Arnold | 112/275 X |
| 4,513,676 | 4/1985 | Martell et al. | 112/275 X |
| 4,589,360 | 5/1986 | Yasui | 112/121.11 |
| 4,593,633 | 6/1986 | Leclaire | 112/275 X |

FOREIGN PATENT DOCUMENTS

| | | | |
|---|---|---|---|
| 0027313 | 6/1985 | Japan | 112/121.11 |
| 0293077 | 3/1971 | U.S.S.R. | 112/121.11 |

OTHER PUBLICATIONS

Published Japanese Catalog entitled "PMC Preset Counter", (Publication Date Unknown).

National General Catalog, Control Equipment, '84–'85; pp. 748–755. (English Language Version).

*Primary Examiner*—Peter Nerbun

[57] ABSTRACT

A sewing machine control device equipped with an operating switch (10) for instructing the sewing machine to operate and stop by turning on and off the operating switch (10) and a counter (9) for accumulating the duration of a running signal (SRT) produced while the operating switch is in an on state, so that the actual accumulated (total) operating time during which the sewing machine is actually operated can be obtained accurately from the accumulated (total) duration of the running signal (SRT).

8 Claims, 1 Drawing Sheet

SEWING MACHINE CONTROL DEVICE

BACKGROUND OF THE INVENTION

1. Field of the Invention

This invention relates to a sewing machine control device.

2. Background Art

A conventional motor-operated sewing machine is designed to rotate a machine-driving means by operating a clutch to transmit the rotational power of a motor to the machine when a pedal control switch is turned on. In order to quickly stop the machine being driven when a switch is turned off, the clutch is released to isolate the rotation of the machine from that of the motor and a brake is applied. It may be considered as a means for measuring the operating time of the machine to total the periods of time during which the control switch is kept on.

It is, however, not accurate to use the period of time during which the control switch is kept on as the operating time of the machine, since, even after the control switch has turned off, the machine is kept on rotating at a lower speed so that the needle reaches a predetermined position with a desired accuracy. For this reason, a difference unavoidably arises between the actual and measured operating time and the disadvantage is that not only work control but also maintenance time length cannot properly be determined.

SUMMARY OF THE INVENTION

The present invention is intended to solve the above problems and it is therefore an object of the invention to provide a sewing machine control device for allowing conformity between actual and measured operating time.

In order to eliminate the above disadvantage, according to the present invention, the duration of running time during which a running signal is produced is accumulated using a counter so that the operating time can be accurately obtained.

The actual operating time thus conforms to the measured operating time.

DETAILED DESCRIPTION OF THE INVENTION

Figure 1:
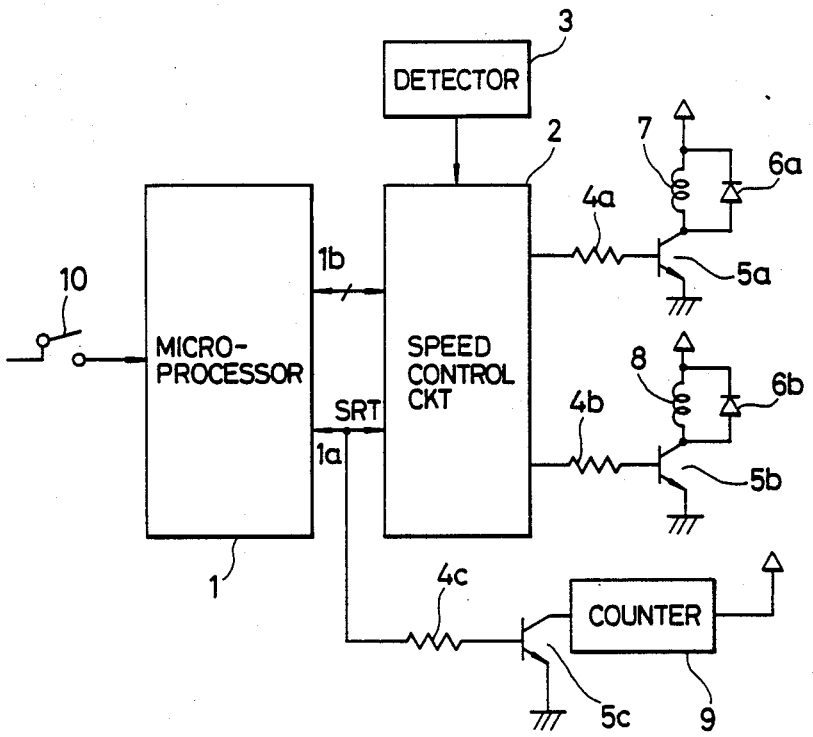
FIG. 1 is a block diagram showing an embodiment of the present invention.

FIG. 1 is a block diagram showing an embodiment of the present invention. In FIG. 1, there is shown a sewing machine control device comprising a microprocessor 1, a speed control circuit 2, a detector for detecting the needle position, resistors 4*a* to 4*c*, transistors 5*a* to 5*c*, diodes 6*a*, 6*b*, a brake solenoid 7, a clutch solenoid 8, a counter for displaying accumulated time, and an operating switch 10.

The operation of the control device thus constructed will now be described. As shown in trace (a) of FIG. 2, the microprocessor 1 produces on its terminal 1*a* a running signal SRT shown in tract (b). On receiving the signal, the speed control circuit 2 drives the clutch solenoid 8, causing the rotation of a motor (not shown) to be transmitted to the machine. The machine thus starts to rotate. At this time, the microprocessor 1 is so arranged as to produce at its terminal 1*b* a first speed control signal for rotating the machine at a predetermined speed and the speed control circuit 2 receives the first speed control signal, and in response, thereto, produces a second speed control signal which allows the machine to rotate at top-speed.

Figure 2:
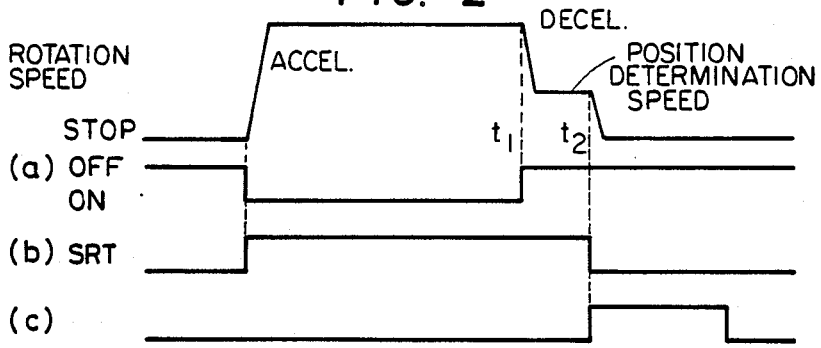
FIGS. 2A–2C a chart showing waveforms in various elements of the embodiment.

When the operating switch 10 is turned off at time $t_1$ as shown in FIG. 2(*a*), the microprocessor 1 alters the first speed-control signal being sent out of the terminal 1*b* for controlling the rotation of the machine and produces another for instructing low-speed operation. The speed control circuit 2 receives this altered first speed control signal, and in response thereto, alters its second speed control signal to also instruct a low speed operation. On the other hand, the detector 3 detects the needle position and supplies the signal detected to the microprocessor 1 through the speed control circuit 2. In consequence, the microprocessor turns off the running signal SRT as shown in trace (b) at time $t_2$ in confirmation of the sufficiently reduced r.p.m. of the machine and the detection of the upper position of the needle. At and after that point of time $t_2$, the speed control circuit 2 is caused to produce a signal for driving the brake solenoid as shown in trace (c) and it simultaneously turns off the clutch solenoid 8. Since the machine is kept at sufficiently low-speed, it stops while the needle remains in the upper position.

As the machine is thus operated, the running signal SRT is produced synchronously with the timing of machine operation. This signal SRT is supplied to the counter 9 through the resistor 4*c* and the transistor 5*c*, so that the counter 9 is reliably operated while the machine is in operation. When the signal SRT is supplied to the counter 9, the time duration of the supply of the signal SRT is accumulated therein by counting the cycles of a fixed period clocking circuit. The machine thus constructed is allowed to operate while the running signal SRT is produced and the counter 9 monitoring the signal displays the actual accumulated operating time.

A great deal of data in view of process control can be obtained, provided the operating time of the machine is accurately available. In other words, preparatory work time is obtained by subtracting the actual operating time from daily work time. The shorter the result obtained, the higher the skilled labor it measures. If the operating time is long in comparison with the number of finished products, it will signify poor results. Important data in view of work control can thus be obtained by making known the operating time of sewing machine.

As set forth above, the operating time of the machine conforms to what is measured by the counter since the operating time thereof is measured by accumulating the duration of the running signal, thus making it possible to check the skill of the worker and obtain accurate information on operating time. Thereby not only preparatory work time but also the level of errors can effectively be controlled on the basis of the operating time and the yield.

What is claimed is:

1. A sewing machine control device comprising;

a switch for instructing a machine to operate or to stop;

control means for producing a first speed control signal and a running signal having a duration indicative of actual operating time of said machine, said control means being responsive to machine operating instructions received from said switch;

stopping means for stopping said machine;

a driving source for driving said machine;

speed control means for producing and supplying a second speed control signal to said machine driving source and a stop signal to said stopping means in accordance with said first speed control signal from said control means; and means for detecting said duration of said running signal and for accumulating a count representative of said duration and of the actual accumulated operating time of said machine.

2. A sewing machine control device as claimed in claim 1, wherein said control device changes said first speed control signal from a first value indicating a high speed to a low value indicating a low non-zero speed in response to receiving one of said machine operating instructions.

3. A sewing machine control device as claimed in claim 2, further comprising a position detector and wherein said control device changes said running signal from a first value to a second value responsive to a signal from said position detector and to receiving said one machine operating instruction from said switch, wherein said speed control means produces said stopping signal in response to said second value of said running signal, and wherein said detecting means detects said duration as a duration of said first value of said running signal.

4. A sewing machine control device as claimed in claim 1, wherein said machine driving source comprises a motor, a clutch for transmitting the rotating force of said motor to said machine, and a solenoid for driving said clutch.

5. A sewing machine control device as claimed in claim 4, wherein switching means is provided between said speed control means and said solenoid and said switching means is made conductive by said speed control signal from said speed control means.

6. A sewing machine control device as claimed in claim 4, wherein said stop means comprises a brake for braking said motor and a solenoid for driving said brake.

7. A sewing machine control device as claimed in claim 6, wherein switching means is provided between said speed control means and said solenoid for braking and wherein said switching means is made conductive by said stop signal from said speed control means.

8. A sewing machine control device as claimed in claim 1, wherein switching means for controlling actuation of said detecting means is actuated by said running signal rendering conductive said switching means.

* * * * *